US008962229B2

(12) United States Patent
Matsumoto et al.

(10) Patent No.: US 8,962,229 B2
(45) Date of Patent: Feb. 24, 2015

(54) ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

(71) Applicant: Fuji Xerox Co., Ltd., Tokyo (JP)

(72) Inventors: Akira Matsumoto, Kanagawa (JP); Yukiaki Nakamura, Kanagawa (JP); Satoshi Kamiwaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 92 days.

(21) Appl. No.: 13/874,940

(22) Filed: May 1, 2013

(65) Prior Publication Data

US 2014/0134526 A1 May 15, 2014

(30) Foreign Application Priority Data

Nov. 13, 2012 (JP) ..... 2012-249448

(51) Int. Cl.
*G03G 9/08* (2006.01)
*G03G 9/087* (2006.01)

(52) U.S. Cl.
CPC ..... *G03G 9/08755* (2013.01); *G03G 9/08791* (2013.01)
USPC ..... 430/109.4; 430/109.3; 430/109.5

(58) Field of Classification Search
CPC ..... G03G 9/08755
USPC ..... 430/109.4, 109.3, 109.5; 399/252
See application file for complete search history.

(56) References Cited

U.S. PATENT DOCUMENTS

2010/0055592 A1 3/2010 Zhou et al.
2012/0107737 A1 5/2012 Zhou et al.

FOREIGN PATENT DOCUMENTS

JP A-2010-055092 3/2010

*Primary Examiner* — Mark A Chapman
(74) *Attorney, Agent, or Firm* — Oliff PLC

(57) ABSTRACT

An electrostatic charge image developing toner is configured of a polycondensate of a polyol and a polycarboxylic acid including a trimellitic acid, includes a polyester resin with an ethylenic unsaturated bond, and has toner particles including a reaction product of the polyester resin and a compound having an imidazoline structure in a surface part, a molar ratio of the trimellitic acid is from 0.1 mol % to 10 mol % with respect to the entire polymerization components of the polyester resin, and a weight ratio of the compound having an imidazoline structure is from 0.1% by weight to 10% by weight with respect to the total weight of the toner particles excluding the compound having an imidazoline structure.

11 Claims, 2 Drawing Sheets

ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2012-249448 filed Nov. 13, 2012.

BACKGROUND

1. Technical Field

The present invention relates to an electrostatic charge image developing toner, an electrostatic charge image developer, a toner cartridge, a process cartridge, an image forming apparatus, and an image forming method.

2. Related Art

In recent years, image forming apparatuses mainly including printers and copiers are in widespread use, and there is also a widespread use of techniques related to various elements of image forming apparatuses. Among image forming apparatuses, there are image forming apparatuses employing an electrophotographic system in which in many cases, a photoreceptor (image holding member) is charged using a charging device and an electrostatic latent image having a potential different from the surrounding potential is formed on the charged photoreceptor to form a pattern, and the electrostatic latent image formed in this manner is developed with a toner, and is then finally transferred onto a recording medium such as a recording sheet.

SUMMARY

According to an aspect of the invention, there is provided an electrostatic charge image developing toner that is configured of a polycondensate of a polyol and a polycarboxylic acid including a trimellitic acid, includes a polyester resin with an ethylenic unsaturated bond, and has toner particles including a reaction product of the polyester resin and a compound having an imidazoline structure in a surface part, wherein a molar ratio of the trimellitic acid is from 0.1 mol % to 10 mol % with respect to the entire polymerization components of the polyester resin, and a weight ratio of the compound having an imidazoline structure is from 0.1% by weight to 10% by weight with respect to the total weight of the toner particles excluding the compound having an imidazoline structure.

BRIEF DESCRIPTION OF THE DRAWINGS

Exemplary embodiments of the present invention will be described in detail based on the following figures, wherein.

DETAILED DESCRIPTION

Figure 1:
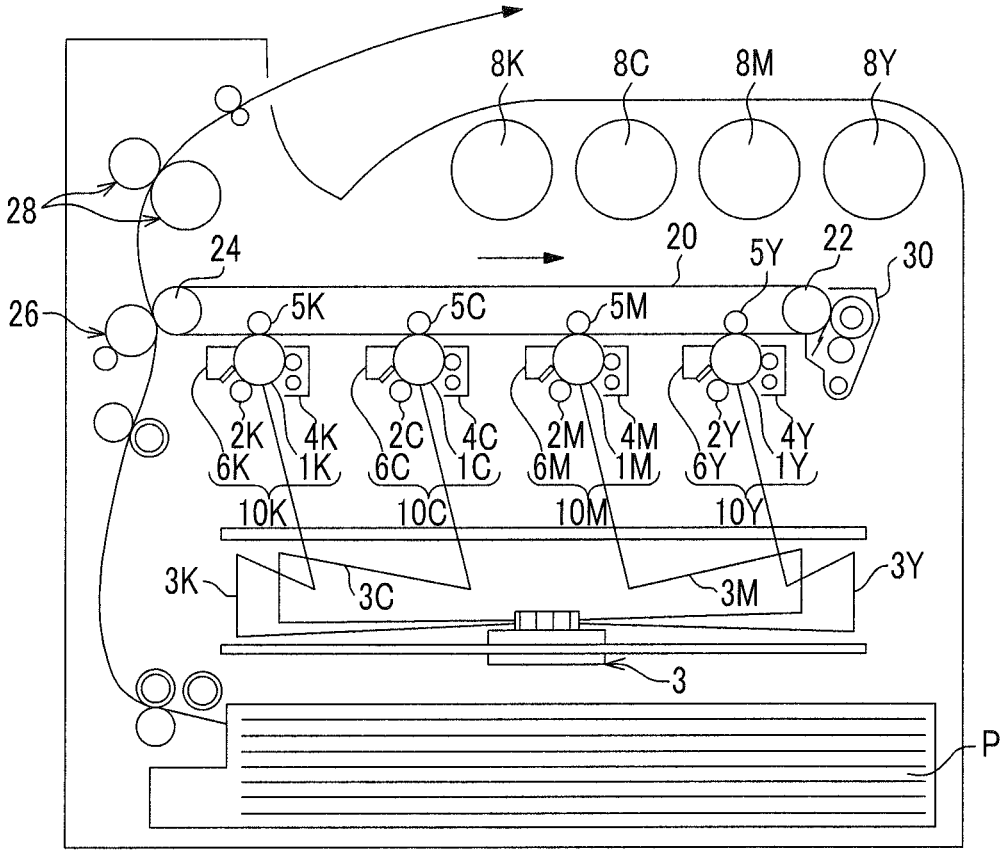
FIG. 1 is a schematic diagram showing the configuration of an example of an image forming apparatus according to an exemplary embodiment.

Hereinafter, an exemplary embodiment of the invention will be described in detail.

Electrostatic Charge Image Developing Toner

An electrostatic charge image developing toner (hereinafter, may be referred to as "toner") according to this exemplary embodiment has toner particles including a polyester resin (hereinafter, referred to as "specific polyester resin") with an ethylenic unsaturated bond that is configured of a polycondensate of a polyol and a polycarboxylic acid including a trimellitic acid.

In addition, surface parts of the toner particles are configured to include a reaction product of the specific polyester resin and a compound having an imidazoline structure.

The molar ratio of the trimellitic acid is set from 0.1 mol % to 10 mol % with respect to the entire polymerization components of the polyester resin, and the weight ratio of the compound having an imidazoline structure is set from 0.1% by weight to 10% by weight with respect to the total weight of the toner particles excluding the compound having an imidazoline structure.

A trimellitic acid anhydride is also included in the trimellitic acid.

Here, in the related art, when a toner having a positive charging property (hereinafter, referred to as "positively-charged toner") is prepared, the toner is realized by blending a charge-controlling agent in the toner particles.

However, when the charge-controlling agent is blended in the toner particles to realize the positively-charged toner, the charge-controlling agent may leave the toner particles, and positive charge maintainability becomes insufficient in this situation. Insufficient positive charge maintainability means that regarding the charged amount of the positively-charged toner, the charged amount distribution is wide and the charged amount of the toner is not appropriate, and as a result, so-called fogging in which the toner particles adhere to a non-image part, or in-apparatus dirt in which the toner is scattered and contaminates the inside of the device occurs, and a state in which it is difficult to appropriately suppress a reduction in the image density is shown.

On the other hand, in the toner according to this exemplary embodiment, the positive charging property is maintained.

The reason for this is not clear, but it is thought that the reason is as follows.

First, it is thought that when the specific polyester resin includes a component derived from the trimellitic acid as a polymerization component, the polarity at a molecular level appropriately increases. In addition, it is thought that when surface parts of the toner particles including the specific polyester resin having a high polarity include a reaction product obtained by reacting the specific polyester resin (its ethylenic unsaturated bond part) with a compound having an imidazoline structure, the imidazoline structure part is easily oriented toward the outside of the toner particles.

It is thought that when the imidazoline structure part is oriented toward the outside of the toner particles in the surface parts of the toner particles, nitrogen atoms with a strong positive charging property that constitute the imidazoline structure are easily present in the surface of the toner particles. As a result, it is thought that the toner particles are positively charged. In addition, it is thought that since the positive charging is realized in a state in which the compound having an imidazoline structure is chemically bonded to the specific polyester resin, the positive charge maintainability of the toner particles is suppressed.

When the molar ratio of the trimellitic acid and the weight ratio of the compound having an imidazoline structure are in the above ranges, respectively, an excessive increase in the polarity of the toner particles is suppressed. As a result, it is thought that a reduction in the charging property due to moisture absorption is suppressed and the toner particles are positively charged by virtue of the compound having an imidazoline structure.

From the above description, it is thought that the positive charge maintainability is suppressed in the toner according to this exemplary embodiment.

In an image forming apparatus (method) and the like using the toner according to this exemplary embodiment, image formation using a positively-charged toner is realized over a long time.

A technique of using a compound having an imidazoline structure as a polymerization initiator to crosslink surface parts of toner particles (JP-A-2010-55092 or the like) has been known. However, the compound having an imidazoline structure (particularly, imidazoline structure part) is more likely to be hydrophobic, and has a strong affinity for a polymerizable monomer at the time of polymerization and for a resin of toner particles after polymerization. Accordingly, in case of toner particles prepared using this technique, the compound having an imidazoline structure (particularly, imidazoline structure part) is drawn into the resin and present in the toner particles, and as a result, a preferable positively-charged toner is not obtained.

Hereinafter, a configuration of the toner according to this exemplary embodiment will be described in detail.

The toner according to this exemplary embodiment has toner particles, and if necessary, an external additive.

First, toner particles will be described.

Toner particles are configured to include a specific polyester resin as a binder resin, and if necessary, a colorant, a release agent, and other additives.

Surface parts of the toner particles are configured to include a reaction product of the specific polyester resin and a compound having an imidazoline structure. The configuration of the toner particles is realized by, for example, performing a surface treatment on the surfaces of the toner particles with the compound having an imidazoline structure.

The compound having an imidazoline structure will be described.

The compound having an imidazoline structure is a compound having, together with the imidazoline structure, a reactive group that reacts with an ethylenic unsaturated bond of the specific polyester resin in the same molecule.

Specific examples of the compound having an imidazoline structure include a compound including an imidazoline structure and an azo group in the same molecule, 2-phenyl-2-imidazoline, 1-(2-chlorophenyl)-imidazoline-2-thione, and 2-(nitroimino)-imidazoline.

Among them, a compound including an imidazoline structure and an azo group in the same molecule is preferable from the viewpoint of positive charging of the toner. This compound is a compound functioning as a polymerization initiator, and it is thought that when surfaces of toner particles are treated with this compound, this compound reacts with the specific polyester resin (its ethylenic unsaturated bond part), and chains of the specific polyester resin (their ethylenic unsaturated bonds) react with each other, and it is thought that a crosslinked product is formed in the surface parts of the toner particles.

Examples of the compound including an imidazoline structure and an azo group in the same molecule include 2,2'-azobis[2-(2-imidazoline-2-yl)propane]dihydrochloride, 2,2'-azobis[2-(2-imidazoline-2-yl)propane]disulfate.anhydride, 2,2'-azobis{2-[1-(2-hydroxyethyl)-2-imidazoline-2-yl] propane}dihydrochloride, and 2,2'-azobis[2-(2-imidazoline-2-yl)propane].

The weight ratio of the compound having an imidazoline structure is from 0.1% by weight to 10% by weight, preferably from 0.5% by weight to 5.0% by weight, and more preferably from 0.8% by weight to 3.0% by weight with respect to the total weight of the toner particles excluding the compound having an imidazoline structure.

When the weight ratio of the compound having an imidazoline structure is 0.1% by weight or greater, the positive charge maintainability of the toner is suppressed.

When the weight ratio of the compound having an imidazoline structure is 10% by weight or less, an excessive increase in the polarity of the toner particles is suppressed, and as a result, a reduction in the charging property due to moisture absorption is suppressed and the positive charge maintainability of the toner is suppressed.

The binder resin will be described.

At least a specific polyester resin is applied as the binder resin.

The specific polyester resin is a polyester resin with an ethylenic unsaturated bond that is configured of a polycondensate of a polyol and a polycarboxylic acid including a trimellitic acid.

Specific examples of the specific polyester resin include a polycondensate of a polyol and a polycarboxylic acid including a trimellitic acid, and a monomer with an ethylenic unsaturated bond (for example, vinyl group) may be used as at least one of the polyol and the polycarboxylic acid.

Particularly, the specific polyester resin is, for example, a polycondensate of a polyol and a polycarboxylic acid including a trimellitic acid, and a monomer with an ethylenic unsaturated bond (for example, vinyl group) may be preferably used as the polycarboxylic acid. That is, the specific polyester resin may be a polycondensate of a polyol and a polycarboxylic acid including a carboxylic acid with an ethylenic unsaturated bond (for example, vinyl group) and a trimellitic acid.

Among polycarboxylic acids, examples of the carboxylic acid with an ethylenic unsaturated bond (for example, vinyl group) include fumaric acid, maleic acid, maleic anhydride, citraconic acid, mesaconic acid, 2-pentendioic acid, methylenesuccinic acid, and lower alkyl esters thereof (having from 1 to 5 carbon atoms).

Examples of other polycarboxylic acids include divalent carboxylic acids such as dibasic acid, e.g., alkylsuccinic acid, alkenylsuccinic acid, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexanedicarboxylic acid, malonic acid, and mesaconic acid, anhydrides thereof, and lower alkyl esters thereof (having from 1 to 5 carbon atoms).

Examples of other polycarboxylic acids also include tri- or higher-valent carboxylic acids such as 1,2,4-naphthalenetricarboxylic acid, anhydrides thereof, and lower alkyl esters thereof (having from 1 to 5 carbon atoms).

These polycarboxylic acids may be used singly or in combination of two or more types thereof.

Examples of the polyol include divalent alcohols such as bisphenol A, hydrogenated bisphenol A, adduct of at least one of ethylene oxide and propylene oxide of bisphenol A, 1,4-cyclohexanediol, 1,4-cyclohexanedimethanol, ethylene glycol, diethylene glycol, propylene glycol, dipropylene glycol, 1,3-butanediol, 1,4-butanediol, 1,5-pentanediol, 1,6-hexanediol, 1,9-nonanediol, and neopentyl glycol.

Examples of the polyol also include tri- or higher-valent alcohols such as glycerin, trimethylol ethane, trimethylol propane, and pentaerythritol.

If necessary, in order to adjust the acid value or the hydroxyl value, a monovalent acid such as acetic acid and benzoic acid, or a monovalent alcohol such as cyclohexanol and benzyl alcohol may be used in combination with the polyol.

These polyols may be used singly or in combination of two or more types thereof.

Here, in the specific polyester resin, the molar ratio of the trimellitic acid is from 0.1 mol % to 10 mol %, preferably from 0.5 mol % to 5.0 mol %, and more preferably from 0.8 mol % to 3.0 mol % with respect to the entire polymerization components (entire monomers used: entire polycarboxylic acids and polyols used) of the specific polyester resin.

When the molar ratio of the trimellitic acid is 0.1 mol % or greater, the toner is positively charged.

When the molar ratio of the trimellitic acid is 10 mol % or less, an excessive increase in the polarity of the toner particles is suppressed, and as a result, a reduction in the charging property due to moisture absorption is suppressed and the positive charging of the toner is maintained.

Meanwhile, the molar ratio of the monomer (for example, carboxylic acid) having an ethylinic unsaturated bond (for example, vinyl group) may be from 0.1 mol % to 80 mol %, is preferably from 1.0 mol % to 50 mol %, and more preferably from 10 mol % to 30 mol % with respect to the entire polymerization components (entire monomers used) of the specific polyester resin, from the viewpoint of maintaining the positive charging property of the toner.

The method of manufacturing the specific polyester resin is not particularly limited, and the specific polyester resin is manufactured using a common polyester polymerization method including reacting a polycarboxylic acid with a polyol. Direct polycondensation, an ester exchange method, or the like is exemplified and methods are selected for manufacturing in accordance with the type of the monomer.

The weight average molecular weight (Mw) of the specific polyester resin may be, for example, from 30,000 to 300,000, is preferably from 30,000 to 200,000, and more preferably from 35,000 to 150,000.

The weight average molecular weight is measured by gel permeation chromatography (CPC). The molecular weight measurement by GPC is performed in a THF solvent, using a GPC HLC-8120 manufactured by Tosoh Corporation as a measuring device and using a Column TSKgel Super HM-M (15 cm) manufactured by Tosoh Corporation. The weight average molecular weight and the number average molecular weight are calculated from the result of this measurement, using a molecular weight calibration curve plotted using a monodisperse polystyrene standard sample. The same hereinafter.

The glass transition temperature (Tg) of the specific polyester resin is, for example, preferably from 50° C. to 80° C., and more preferably from 50° C. to 65° C.

The glass transition temperature is a value that is obtained as the peak temperature of an endothermic peak obtained by differential scanning calorimetry (DSC). The same hereinafter.

The content of the specific polyester resin may be, for example, from 40% by weight to 95% by weight, is preferably from 50% by weight to 90% by weight, and more preferably from 60% by weight to 85% by weight with respect to the entire toner particles.

Other binder resins will be described.

Examples of other binder resins include known resins such as polyester resins other than the specific polyester resin, vinyl resins, styrene/acryl resins, epoxy resins, polyester resins, polyurethane resins, polyamide resins, cellulose resins, polyether resins, and polyolefin resins.

The above other binder resins are blended in such a range that toner characteristics are not affected.

The colorant will be described.

The colorant is not particularly limited as long as it is a known colorant, and examples thereof include carbon blacks such as Furnace black, Channel black, Acetylene black, and Thermal black, inorganic pigments such as red iron oxide, Prussian blue, and titanium oxide, azo pigments such as fast yellow, diazo yellow, pyrazolone red, chelate red, brilliant carmine, and Para Brown, phthalocyanine pigments such as copper phthalocyanine and non-metallic phthalocyanine, and fused polycyclic pigments such as flavanthrone yellow, dibromoanthrone orange, perylene red, quinacridone red, and dioxazine violet.

The colorant may be subjected to a surface treatment, if necessary, or may be used in combination with a dispersant. In addition, plural kinds of colorants may be used in combination.

The content of the colorant is preferably from 1 part by weight to 30 parts by weight with respect to 100 parts by weight of the binder resin.

The release agent will be described.

Examples of the release agent include, but are not limited to, hydrocarbon waxes; natural waxes such as carnauba wax, rice wax, and candelilla wax; synthetic or mineral/petroleum waxes such as montan wax; and ester waxes such as fatty acid esters and montanic acid esters.

The melting temperature of the release agent is preferably 50° C. or higher, and more preferably 60° C. or higher from the viewpoint of preserving property. In addition, the melting temperature is preferably 110° C. or lower, and more preferably 100° C. or lower from the viewpoint of offset resistance.

The content of the release agent is, for example, preferably from 2 parts by weight to 30 parts by weight with respect to 100 parts by weight of the binder resin.

Other additives will be described.

Examples of other additives include a magnetic material and an inorganic powder.

Characteristics of the toner particles will be described.

The toner particles may be toner particles having a single layer structure, or toner particles having a so-called core-shell structure configured by a core (core particle) and a cover layer (shell layer) that covers the core.

In case of toner particles having a core-shell structure, the cover layer (shell layer) may be configured to include the specific polyester resin, and the core (core particle) may be configured to include the specific polyester resin, and if necessary, a colorant, a release agent, and other additives.

The specific polyester resin is not necessarily applied as a binder resin that constitutes the core (core particle). In place of this, other amorphous resins may be applied.

The volume average particle size of the toner particles may be, for example, from 2.0 μm to 10 μm, and is preferably from 4.0 μm to 8.0 μm.

In a method of measuring the volume average particle size of the toner particles, from 0.5 mg to 50 mg of a measurement sample is added to 2 ml of a 5% by weight aqueous solution of, as a dispersant, a surfactant, preferably sodium alkylbenzene sulfonate. This mixture is added to from 100 ml to 150 ml of the electrolyte. The electrolyte containing the measurement sample suspended therein is subjected to a dispersion treatment for about 1 minute by an ultrasonic disperser, thereby measuring a particle size distribution of particles having a particle size of from 2.0 μm to 60 μm by a Coulter Multisizer II (manufactured by Beckman Coulter Inc.) using an aperture having an aperture diameter of 100 μm. The number of particles to be measured is 50,000.

Regarding the volume, a cumulative distribution is drawn from the small diameter side with respect to particle size ranges (channels) divided on the basis of the obtained particle size distribution. A particle size at an accumulation of 50% is defined as a volume average particle size D50v.

The external additive will be described.

Examples of the external additive include inorganic particles, and examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

A surface of the external additive may be subjected to a hydrophobization treatment in advance. The hydrophobization treatment is performed by, for example, dipping the inorganic particles in a hydrophobizing agent. The hydrophobizing agent is not particularly limited, and examples thereof include silane coupling agents, silicone oils, titanate coupling agents, and aluminum coupling agents. These may be used singly or in combination of two or more types thereof.

Generally, the amount of the hydrophobizing agent is, for example, from about 1 part by weight to about 10 parts by weight with respect to 100 parts by weight of the inorganic particles.

The amount of the external additive to be externally added may preferably be, for example, from 0.5 part by weight to 2.5 parts by weight with respect to 100 parts by weight of the toner particles.

A method of manufacturing the toner according to this exemplary embodiment will be described.

First, toner particles may be manufactured using any of a dry manufacturing method (for example, a kneading pulverization method) and a wet manufacturing method (for example, an aggregation and coalescence method, a suspension polymerization method, a dissolution suspension granulation method, a dissolution suspension method, and a dissolution emulsification aggregation and coalescence method). The methods of manufacturing the toner particles are not particularly limited, and a known manufacturing method is employed.

A specific polyester resin (its ethylenic unsaturated bond) present in surface parts of the obtained toner particles is reacted with a compound having an imidazoline structure, thereby forming a reaction product by the above reaction in the surface parts of the toner particles.

Specifically, for example, when the toner particles are manufactured using the aggregation and coalescence method, the toner particles are manufactured through a process in which, for example, at least a polyester resin particle dispersion containing specific polyester resin particles dispersed therein is prepared, and at least the specific polyester resin is aggregated to form aggregated particles, a process (coalescence process) in which an aggregated particle dispersion containing the aggregated particles dispersed therein is heated to coalesce the aggregated particles, thereby forming toner particles, and a process in which a compound having an imidazoline structure is added to a toner particle dispersion containing the toner particles dispersed therein to react the specific polyester resin present in surface parts of the toner particles with the compound having an imidazoline structure, thereby forming a reaction product by the reaction in the surface parts of the toner particles.

The aggregated particles may be first aggregated particles, a first aggregated particle dispersion containing the first aggregated particles dispersed therein and a polyester resin particle dispersion containing specific polyester resin particles dispersed therein may be mixed to aggregate such that the specific polyester resin particles adhere to surfaces of the first aggregated particles, thereby forming second aggregated particles. And the second aggregated particles may be coalesced to form toner particles.

Hereinafter, the respective processes will be described in detail.

In the following description, a method of obtaining toner particles including a colorant and a release agent will be described. However, the colorant and the release agent are used only if necessary. Other additives other than the colorant and the release agent may also be used.

First Aggregated Particle Forming Process

First, together with a resin particle dispersion containing resin particles dispersed therein, for example, a colorant particle dispersion containing colorant particles dispersed therein and a release agent dispersion containing release agent particles dispersed therein are prepared.

The resin particles dispersed in the resin particle dispersion are specific polyester resin particles.

Regarding the resin particle dispersion, when two or more types of resin particles are applied, resin particle dispersions of the respective resin particles may be prepared and mixed to prepare one resin particle dispersion. Otherwise, the resin particle dispersions of the respective resin particles may be mixed when being mixed with the colorant particle dispersion and the release agent particle dispersion.

The resin particle dispersion is prepared by, for example, dispersing the resin particles in a dispersion medium by a surfactant.

Examples of the dispersion medium that is used for the resin particle dispersion include an aqueous medium.

Examples of the aqueous medium include water such as distilled water and ion exchange water and alcohols. These may be used singly or in combination of two or more types thereof.

The surfactant is not particularly limited, and examples thereof include anionic surfactants such as sulfate, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyol nonionic surfactants. Among them, anionic surfactants and cationic surfactants are particularly preferable. Nonionic surfactants may be used in combination with anionic surfactants or cationic surfactants.

The surfactants may be used singly or in combination of two or more types thereof.

Regarding the resin particle dispersion, as a method of dispersing the resin particles in the dispersion medium, for example, common dispersing methods using, for example, a rotary shearing-type homogenizer, a ball mill having media, a sand mill, and a Dyno mill are exemplified. In accordance with the type of resin particles to be used, resin particles may be dispersed in the resin particle dispersion using, for example, a phase-transfer emulsification method.

The phase-transfer emulsification method is a method of dispersing a resin in a particulate state in an aqueous medium, including: dissolving a resin to be dispersed in a hydrophobic organic solvent in which the resin is soluble; adding a base to an organic continuous phase (O phase) to neutralize the solution; and putting an aqueous medium (W phase) to carry out a conversion of the resin (so-called phase inversion) from W/O to O/W to thereby make a discontinuous phase.

The volume average particle size of the resin particles that are dispersed in the resin particle dispersion is, for example, from 0.01 μm to 1 μm, or may be from 0.08 μm to 0.8 μm, or from 0.1 μm to 0.6 μm.

The volume average particle size of the resin particles is measured using a laser diffraction-type particle size distribution measuring device (manufactured by Horiba, Ltd. LA-920). Hereinafter, the volume average particle size of the particles is measured in the same manner unless specifically noted.

The content of the resin particles that are contained in the resin particle dispersion is, for example, from 5% by weight to 50% by weight, and may be from 10% by weight to 40% by weight.

The colorant dispersion and the release agent dispersion are also prepared in the same manner as in the case of the resin particle dispersion. That is, the volume average particle size of the particles, the dispersion medium, the dispersing method, and the content of the particles in the dispersion of the resin particles are the same as those of the colorant particles that are dispersed in the colorant dispersion and the release agent particles that are dispersed in the release agent dispersion.

Next, the colorant particle dispersion and the release agent dispersion are mixed together with the resin particle dispersion.

The resin particles, the colorant particles, and the release agent particles are heterogeneously aggregated in the mixed dispersion to form first aggregated particles (core aggregated particles) containing the resin particles, the colorant particles, and the release agent particles having a particle size near a desired toner particle size.

Specifically, for example, an aggregating agent is added to the mixed dispersion, a pH of the mixed dispersion is adjusted to acidic (for example, the pH is from 2 to 5), and if necessary, a dispersion stabilizer is added. Then, the mixed dispersion is heated to a glass transition temperature of the resin particles (specifically, for example, from a temperature 30° C. lower-than the glass transition temperature of the resin particles, to a temperature 10° C. lower than the vicat softening temperature) to aggregate the particles dispersed in the mixed dispersion, thereby forming the first aggregated particles.

In the first aggregated particle forming process, for example, the aggregating agent may be added at room temperature (for example, 25° C.) during stirring of the mixed dispersion using a rotary shearing-type homogenizer, the pH of the mixed dispersion may be adjusted to acidic (for example, the pH is from 2 to 5), and if necessary, a dispersion stabilizer is added, and the heating may be then performed.

Examples of the aggregating agent include a surfactant having an opposite polarity of the polarity of the surfactant that is used as the dispersant to be added to the mixed dispersion, such as inorganic metal salts and di- or higher-valent metal complexes. Particularly, when a metal complex is used as the aggregating agent, the amount of the surfactant to be used is reduced and charging characteristics are improved.

If necessary, an additive may be used to form a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples thereof include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent to be added is, for example, from 0.01 part by weight to 5.0 parts by weight, and may be from 0.1 part by weight to less than 3.0 parts by weight with respect to 100 parts by weight of the resin particles.

Second Aggregated Particle Forming Process

Next, the obtained first aggregated particle dispersion containing the aggregated particles dispersed therein and a specific polyester resin particle dispersion containing specific polyester resin particles dispersed therein are mixed with each other.

In the mixed dispersion, the specific polyester resin particles are aggregated so as to adhere to surfaces of the first aggregated particles, thereby forming second aggregated particles in which the specific polyester resin particles adhere to the surfaces of the first aggregated particles.

Specifically, for example, in the first aggregated particle forming process, when the particle size of the first aggregated particles reach a target particle size (for example, the volume average particle size is 1.5 μm or greater, and preferably from 2.5 μm to 6.5 μm), the first aggregated particle dispersion is mixed with the specific polyester resin particle dispersion, and this mixed dispersion is heated to a temperature that is equal to or lower than a lower one of the glass transition temperatures of the first aggregated particles and the specific polyester resin particles.

The aggregation is terminated by adjusting a pH of the mixed dispersion to, for example, from about 6.5 to about 8.5.

Here, the volume average particle size of the specific polyester resin particles that are dispersed in the specific polyester resin particle dispersion is, for example, from 0.01 μm to 1 μm, and may be from 0.05 μm to 0.8 μm, or from 0.1 μm to 0.6 μm. Particularly, the volume average particle size may preferably be less than 0.3 μm (300 nm).

Accordingly, the second aggregated particles are obtained in which the specific polyester resin particles are aggregated so as to adhere to the surfaces of the first aggregated particles.

Coalescence Process

Next, a second aggregated particle dispersion containing the second aggregated particles dispersed therein is heated to, for example, a temperature that is higher than the glass transition temperature of the specific polyester resin (for example, a temperature that is higher than the glass transition temperature of the specific polyester resin by from 10° C. to 30° C.) to coalesce the second aggregated particles, thereby forming toner particles.

Reaction Product Forming Process

A compound having an imidazoline structure is added to a toner particle dispersion containing the toner particles dispersed therein to react the specific polyester resin present in surface parts of the toner particles with the compound having an imidazoline structure, thereby forming a reaction product by the reaction in the surface parts of the toner particles.

The reaction product may be formed preferably under conditions of a reaction temperature of from 50° C. to 100° C. (preferably from 60° C. to 90° C.) and a reaction time of from 1 hour to 7 hours (preferably from 2 hours to 5 hours).

Through the above processes, toner particles (toner particles having a core-shell structure) are obtained, that are configured by a core including the specific polyester resin and other additives and a cover layer including the specific polyester resin that covers the core.

In the surface parts of the toner particles, reaction product of the specific polyester resin and the compound having an imidazoline structure is formed.

After the coalescence process, the toner particles formed in the solution are subjected to a washing process, a solid-liquid separation process, and a drying process that are well known, and thus dried toner particles are obtained.

In the washing process, displacement washing with ion exchange water is preferably sufficiently performed in consideration of charging property. In addition, the solid-liquid separation process is not particularly limited, but suction filtration, pressure filtration, or the like is preferably used in consideration of productivity. Furthermore, the drying process is also not particularly limited, but freeze drying, flash jet drying, fluidized drying, vibration-type fluidized drying, or the like is preferably used in consideration of productivity.

The toner according to this exemplary embodiment is manufactured by, for example, adding an external additive to the obtained dry toner particles and mixing them. The mixing may be preferably performed with a V-blender, a Henschel mixer, or a Roedige mixer. Furthermore, if necessary, coarse toner particles may be removed using a vibrating sieve, a wind-power sieve, or the like.

Electrostatic Charge Image Developer

An electrostatic charge image developer according to this exemplary embodiment contains at least the toner according to this exemplary embodiment.

The electrostatic charge image developer according to this exemplary embodiment may be a single-component developer containing only the toner according to this exemplary embodiment, or a two-component developer obtained by mixing the toner with a carrier.

In addition, the single-component developer may be a non-magnetic single-component developer (non-magnetic single-component toner), or a magnetic single-component developer (magnetic single-component toner).

The carrier is not particularly limited, and a known carrier for a positively-charged toner is exemplified. Examples of the carrier include a resin-coated carrier, a magnetic dispersion-type carrier, and a resin dispersion-type carrier.

The mixing ratio (weight ratio) of the toner according to this exemplary embodiment to the carrier in the two-component developer is preferably from about 1:100 to about 30:100 (toner:carrier), and more preferably from about 3:100 to about 20:100.

Image Forming Apparatus and Image Forming Method

Next, an image forming apparatus and an image forming method according to this exemplary embodiment will be described.

The image forming apparatus according to this exemplary embodiment has an image holding member, a charging unit that charges the image holding member, an electrostatic charge image forming unit that forms an electrostatic charge image on a surface of the charged image holding member, a developing unit that accommodates an electrostatic charge image developer and develops the electrostatic charge image formed on the image holding member with the electrostatic charge image developer to form a toner image, a transfer unit that transfers the toner image formed on the image holding member onto a recording medium, and a fixing unit that fixes the toner image transferred onto the recording medium. As the electrostatic charge image developer, the electrostatic charge image developer according to this exemplary embodiment is applied.

In the image forming apparatus according to this exemplary embodiment, a part including the developing unit may have a cartridge structure (process cartridge) that is detachable from an image forming apparatus. As the process cartridge, for example, a process cartridge that accommodates the electrostatic charge image developer according to this exemplary embodiment and is provided with a developing unit is preferably used.

The image forming method according to this exemplary embodiment has a charging process of charging an image holding member, an electrostatic charge image forming process of forming an electrostatic charge image on a surface of the charged image holding member, a developing process of developing the electrostatic charge image formed on the image holding member with an electrostatic charge image developer to form a toner image, a transfer process of transferring the toner image formed on the image holding member onto a recording medium, and a fixing process of fixing the toner image transferred onto the recording medium. As the electrostatic charge image developer, the electrostatic charge image developer according to this exemplary embodiment is applied.

Hereinafter, an example of the image forming apparatus according to this exemplary embodiment will be shown, but the apparatus is not limited thereto. The main parts shown in the drawings will be described, but descriptions of other parts will be omitted.

FIG. 1 is a schematic diagram showing a configuration of a four-drum tandem-type color image forming apparatus. The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roller 22 and a support roller 24 contacting the inner surface of the intermediate transfer belt 20, which are separated from each other on the left and right sides in the drawing, and travels in a direction toward the fourth unit 10K from the first unit 10Y. The support roller 24 is pressed in a direction in which it departs from the driving roller 22 by a spring or the like (not shown), and a tension is given to the intermediate transfer belt 20 wound on both of the rollers. In addition, an intermediate transfer member cleaning device 30 opposed to the driving roller 22 is provided on a surface of the intermediate transfer belt 20 on the image holding member side.

Developing devices (developing units) 4Y, 4M, 4C, and 4K of the units 10Y, 10M, 10C, and 10K are supplied with toners including four color toners, that is, a yellow toner, a magenta toner, a cyan toner, and a black toner accommodated in toner cartridges 8Y, 8M, 8C, and 8K, respectively.

The above-described first to fourth units 10Y, 10M, 10C, and 10K have the same configuration. Here, only the first unit 10Y that is disposed on the upstream side in a traveling direction of the intermediate transfer belt to form a yellow image will be representatively described. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roller 2Y that charges a surface of the photoreceptor 1Y to a predetermined potential, an exposure device (electrostatic charge image forming unit) 3 that exposes the charged surface with laser beams 3Y based on a color-separated image signal to form an electrostatic charge image, a developing device (developing unit) 4Y that supplies a charged toner to the electrostatic charge image to develop the electrostatic charge image, a primary transfer roller (primary transfer unit) 5Y that transfers the developed toner image onto the intermediate transfer belt 20, and a photoreceptor cleaning device (cleaning unit) 6Y that removes the toner remaining on the surface of the photoreceptor 1Y after primary transfer, are arranged in sequence.

The primary transfer roller 5Y is disposed inside the intermediate transfer belt 20 to be provided at a position opposed to the photoreceptor 1Y. Furthermore, bias supplies (not shown) that apply a primary transfer bias are connected to the primary transfer rollers 5Y, 5M, 5C, and 5K, respectively. The bias supplies change the transfer bias that is applied to each primary transfer roller under the control of a controller (not shown).

Hereinafter, an operation of forming a yellow image in the first unit 10Y will be described. First, before the operation, the surface of the photoreceptor 1Y is charged to a potential of from about −600 V to about −800 V by the charging roller 2Y.

The photoreceptor 1Y is formed by stacking a photosensitive layer on a conductive base (volume resistivity at 20° C.: $1\times10^{-6}$ Ωcm or less). This photosensitive layer typically has high resistance (resistance that is about the same as the resistance of a general resin), but has a property in which when laser beams 3Y are applied, the specific resistance of a part irradiated with the laser beams changes. Accordingly, the laser beams 3Y are output to the surface of the charged photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow print pattern is formed on the surface of the photoreceptor 1Y.

The electrostatic charge image is an image that is formed on the surface of the photoreceptor 1Y by charging, and is a so-called negative latent image, that is formed by applying the laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image that is formed in this manner on the photoreceptor 1Y is rotated up to a predetermined development position with the travelling of the photoreceptor 1Y. The electrostatic charge image on the photoreceptor 1Y is formed as a visual image (developed image) at the development position by the developing device 4Y.

The developing device 4Y accommodates, for example, an electrostatic charge image developer according to this exemplary embodiment including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (developer holding member). By allowing the surface of the photoreceptor 1Y to pass through the developing device 4Y, the yellow toner electrostatically adheres to an erased latent image part on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y and an electrostatic force toward the primary transfer roller 5Y from the photoreceptor 1Y acts on the toner image, whereby the toner image on the photoreceptor 1Y is transferred onto the intermediate transfer belt 20. The transfer bias applied at this time has the opposite polarity (+) of the toner polarity (−), and is controlled to be, for example, about +10 μA in the first unit 10Y by the controller (not shown).

On the other hand, the toner remaining on the photoreceptor 1Y is removed by the cleaning device 6Y and collected.

The primary transfer biases that are applied to the primary transfer rollers 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part which is configured by the intermediate transfer belt 20, the support roller 24 contacting the inner surface of the intermediate transfer belt 20, and a secondary transfer roller (secondary transfer unit) 26 disposed on the image holding surface side of the intermediate transfer belt 20. Meanwhile, a recording sheet (recording medium) P is supplied to a gap between the secondary transfer roller 26 and the intermediate transfer belt 20, which are pressed against each other, via a supply mechanism at a predetermined time, and a secondary transfer bias is applied to the support roller 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (roll-shaped fixing unit) 28, and the toner image is fixed to the recording sheet P, whereby the fixed image is formed.

Examples of the recording medium onto which a toner image is transferred include plain paper that is used in electrophotographic copiers, printers, and the like and OHP sheet.

It is preferred that the surface of the recording medium be smooth in order to improve the smoothness of the image surface after fixing. For example, coating paper obtained by coating a surface of plain paper with a resin or the like, art paper for printing, and the like are preferably used.

The recording sheet P on which the fixing of the color image is completed is transported toward a discharge part, and a series of the color image forming operations ends.

The image forming apparatus exemplified as above has a configuration in which the toner image is transferred onto the recording sheet P via the intermediate transfer belt 20. However, the invention is not limited to this configuration, and may have a structure in which the toner image is transferred directly onto the recording sheet from the photoreceptor.

Process Cartridge and Toner Cartridge

Figure 2:
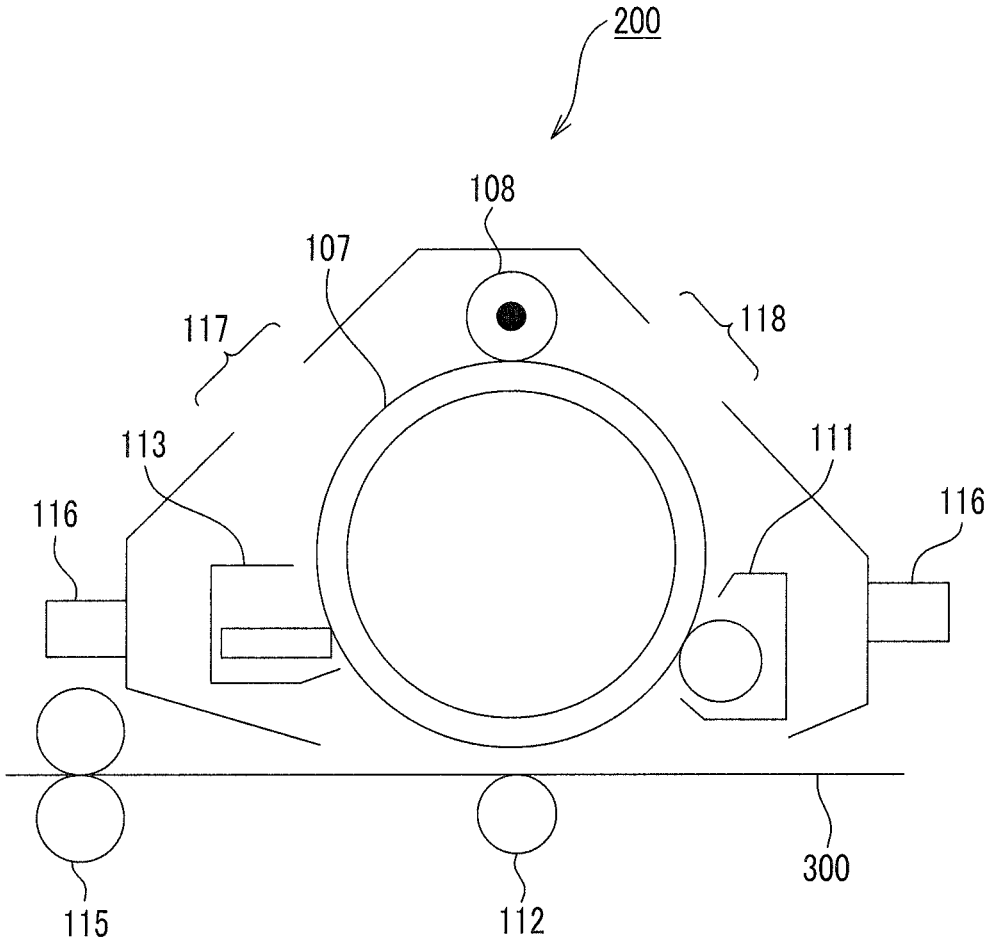
FIG. 2 is a schematic diagram showing the configuration of an example of a process cartridge according to the exemplary embodiment.

FIG. 2 is a schematic diagram showing the configuration of a favorable example of an exemplary embodiment of a process cartridge that accommodates the electrostatic charge image developer according to this exemplary embodiment. A process cartridge 200 has, in addition to a photoreceptor 107, a charging roller 108, a developing device 111, a photoreceptor cleaning device 113, an opening 118 for exposure, and an opening 117 for erasing exposure, and they are combined and integrated using an attachment rail 116. The reference numeral 300 in FIG. 2 denotes a recording medium.

The process cartridge 200 is detachably mounted on an image forming apparatus configured by a transfer device 112, a fixing device 115, and other constituent parts (not shown).

The process cartridge 200 shown in FIG. 2 is provided with the charging roller 108, the developing device 111, the cleaning device 113, the opening 118 for exposure, and the opening 117 for erasing exposure, but these devices may be selectively combined. The process cartridge of this exemplary embodiment is provided with, as well as the photoreceptor 107, at least one selected from the group consisting of the charging device 108, the developing device 111, the cleaning device (cleaning unit) 113, the opening 118 for exposure, and the opening 117 for erasing exposure.

Next, a toner cartridge according to this exemplary embodiment will be described. The toner cartridge according to this exemplary embodiment is a toner cartridge that is detachable from an image forming apparatus and accommodates at least an electrostatic charge image developing toner for replenishment for supplying to the developing unit provided in the image forming apparatus.

The image forming apparatus shown in FIG. 1 is an image forming apparatus that has a configuration in which the toner cartridges 8Y, 8M, 8C, and 8K are detachably mounted. The developing devices 4Y, 4M, 4C, and 4K are connected to the toner cartridges corresponding to the respective developing devices (colors) via toner supply tubes (not shown). In addition, when the toner accommodated in the toner cartridge runs low, the toner cartridge may be replaced.

EXAMPLES

Hereinafter, this exemplary embodiment will be described in detail using examples, but is not limited to the examples. In the following description, unless specifically noted, "parts" and "%" are based on the weight.

Synthesis of Polyester Resin A

Bisphenol-A Ethylene Oxide 2.2-mole Adduct: 40 parts by mole

Bisphenol-A Propylene Oxide 2.2-mole Adduct: 60 parts by mole

Terephthalic Acid: 42.9 parts by mole

Fumaric Acid: 40 parts by mole

Dodecenyl Succinic Anhydride: 15 parts by mole

Trimellitic Anhydride: 2.1 parts by mole

The monomer components described above except for the fumaric acid and the trimellitic anhydride, and 0.25 part by weight of tin dioctanate with respect to 100 parts by weight of the total amount of the above monomer components are put into a reaction container provided with a stirrer, a thermometer, a condenser, and a nitrogen gas supply tube. The components are reacted for 6 hours at 235° C. under a nitrogen gas flow, and then the temperature is lowered to 200° C., and the fumaric acid and the trimellitic anhydride are put into the reaction container to be reacted for 1 hour. The temperature is further increased to 220° C. over 4 hours, and under a pressure of 10 kPa, polymerization is carried out until a desired molecular weight is obtained. Thus, a pale yellow, transparent polyester resin A is obtained.

Preparation of Polyester Resin Particle Dispersion A

While a 3-liter jacketed reaction vessel (manufactured by Tokyo Rikakikai Co., Ltd.: BJ-30N) provided with a condenser, a thermometer, a water-dropping device, and an anchor blade is maintained at 40° C. in a water circulation-type constant temperature bath, a mixed solvent of 160 parts by weight of ethyl acetate and 100 parts by weight of isopropyl alcohol is put into the reaction vessel, and 300 parts by weight of the polyester resin A is put thereinto. The mixture is stirred at 150 rpm using a Three-One motor and is dissolved to obtain an oil phase. 14 parts by weight of a 10% ammonia aqueous solution is added dropwise for a dropping time of 5 minutes to the oil phase that is still being stirred, and the mixture is mixed for 10 minutes. Then, 900 parts by weight of ion exchange water is further added dropwise thereto at a rate of 7 parts by weight per minute to reverse the phase, thereby obtaining an emulsion.

Immediately, 800 parts by weight of the emulsion thus obtained and 700 parts by weight of ion exchange water are placed in a 2-liter eggplant flask, and the flask is mounted on an evaporator (manufactured by Tokyo Rikakikai Co., Ltd.) provided with a vacuum control unit through a trap ball. While the eggplant flask is rotated, the temperature is increased in a hot water bath at 60° C. While caution is taken not to have abrupt boiling, the pressure is reduced to 7 kPa and the solvent is removed. At the time when the amount of the collected solvent is 1,100 parts by weight, the pressure is returned to the normal pressure, and the eggplant flask is water-cooled to obtain a dispersion. The obtained dispersion has no solvent odor. The volume average particle size D50 of the resin particles in this dispersion is 130 nm. Thereafter, ion exchange water is added to adjust the solid content concentration to 20%, and the resultant material is defined as a polyester resin dispersion A.

Synthesis of Polyester Resin B and Preparation of Polyester Resin Particle Dispersion B A polyester resin B is synthesized in the same manner as in the synthesis of the polyester resin A, except that the amount of the terephthalic acid is changed from 42.9 parts by mole used in the synthesis of the polyester resin A to 44.8 parts by mole and the amount of the trimellitic anhydride is changed from 2.1 parts by mole used in the synthesis of the polyester resin A to 0.2 part by mole, and a polyester resin particle dispersion B is prepared in the same manner as in the preparation of the polyester resin particle dispersion A.

Synthesis of Polyester Resin C and Preparation of Polyester Resin Particle Dispersion C A polyester resin C is synthesized in the same manner as in the synthesis of the polyester resin A, except that the amount of the terephthalic acid is changed from 42.9 parts by mole used in the synthesis of the polyester resin A to 44.2 parts by mole and the amount of the trimellitic anhydride is changed from 2.1 parts by mole used in the synthesis of the polyester resin A to 0.8 part by mole, and a polyester resin particle dispersion C is prepared in the same manner as in the preparation of the polyester resin particle dispersion A.

Synthesis of Polyester Resin D and Preparation of Polyester Resin Particle Dispersion D A polyester resin D is synthesized in the same manner as in the synthesis of the polyester resin A, except that the amount of the terephthalic acid is changed from 42.9 parts by mole used in the synthesis of the polyester resin A to 43.6 parts by mole and the amount of the trimellitic anhydride is changed from 2.1 parts by mole used in the synthesis of the polyester resin A to 1.4 parts by mole, and a polyester resin particle dispersion D is prepared in the same manner as in the preparation of the polyester resin particle dispersion A.

Synthesis of Polyester Resin E and Preparation of Polyester Resin Particle Dispersion E A polyester resin E is synthesized in the same manner as in the synthesis of the polyester resin A, except that the amount of the terephthalic acid is changed from 42.9 parts by mole used in the synthesis of the polyester resin A to 41.4 parts by mole, the amount of the fumaric acid is changed from 40 parts by mole used in the synthesis of the polyester resin A to 38 parts by mole, and the amount of the trimellitic anhydride is changed from 2.1 parts by mole used in the synthesis of the polyester resin A to 5.6 parts by mole, and a polyester resin particle dispersion E is prepared in the same manner as in the preparation of the polyester resin particle dispersion A.

Synthesis of Polyester Resin F and Preparation of Polyester Resin Particle Dispersion F A polyester resin F is synthesized in the same manner as in the synthesis of the polyester resin A, except that the amount of the terephthalic acid is changed from 42.9 parts by mole used in the synthesis of the polyester resin A to 43.6 parts by mole, the amount of the fumaric acid is changed from 40 parts by mole used in the synthesis of the polyester resin A to 35 parts by mole, and the amount of the trimellitic anhydride is changed from 2.1 parts by mole used in the synthesis of the polyester resin A to 6.4 parts by mole, and a polyester resin particle dispersion F is prepared in the same manner as in the preparation of the polyester resin particle dispersion A.

Synthesis of Polyester Resin G and Preparation of Polyester Resin Particle Dispersion G A polyester resin G is synthesized in the same manner as in the synthesis of the polyester resin A, except that the amount of the terephthalic acid is changed from 42.9 parts by mole used in the synthesis of the polyester resin A to 40.6 parts by mole, the amount of the fumaric acid is changed from 40 parts by mole used in the synthesis of the polyester resin A to 35 parts by mole, and the amount of the trimellitic anhydride is changed from 2.1 parts by mole used in the synthesis of the polyester resin A to 9.4 parts by mole, and a polyester resin particle dispersion G is prepared in the same manner as in the preparation of the polyester resin particle dispersion A.

Synthesis of Polyester Resin H and Preparation of Polyester Resin Particle Dispersion H A polyester resin H is synthesized in the same manner as in the synthesis of the polyester resin A, except that the amount of the terephthalic acid is changed from 42.9 parts by mole used in the synthesis of the polyester resin A to 39.8 parts by mole, the amount of the fumaric acid is changed from 40 parts by mole used in the synthesis of the polyester resin A to 35 parts by mole, and the amount of the trimellitic anhydride is changed from 2.1 parts by mole used in the synthesis of the polyester resin A to 10.2 parts by mole, and a polyester resin particle dispersion H is prepared in the same manner as in the preparation of the polyester resin particle dispersion A.

Synthesis of Polyester Resin I and Preparation of Polyester Resin Particle Dispersion I A polyester resin I is synthesized in the same manner as in the synthesis of the polyester resin A, except that the amount of the terephthalic acid is changed from 42.9 parts by mole used in the synthesis of the polyester resin A to 34.6 parts by mole, the amount of the fumaric acid is changed from 40 parts by mole used in the synthesis of the polyester resin A to 31 parts by mole, and the amount of the trimellitic anhydride is changed from 2.1 parts by mole used in the synthesis of the polyester resin A to 19.4 parts by mole, and a polyester resin particle dispersion I is prepared in the same manner as in the preparation of the polyester resin particle dispersion A.

Synthesis of Polyester Resin J and Preparation of Polyester Resin Particle Dispersion J A polyester resin J is synthesized in the same manner as in the synthesis of the polyester resin A, except that the amount of the terephthalic acid is changed from 42.9 parts by mole used in the synthesis of the polyester resin A to 34.6 parts by mole, the amount of the fumaric acid is changed from 40 parts by mole used in the synthesis of the polyester resin A to 30 parts by mole, and the amount of the trimellitic anhydride is changed from 2.1 parts by mole used in the synthesis of the polyester resin A to 20.4 parts by mole, and a polyester resin particle dispersion J is prepared in the same manner as in the preparation of the polyester resin particle dispersion A.

Synthesis of Polyester Resin K and Preparation of Polyester Resin Particle Dispersion K A polyester resin K is synthesized in the same manner as in the synthesis of the polyester resin A, except that the amount of the terephthalic acid is changed from 42.9 parts by mole used in the synthesis of the polyester resin A to 44.84 parts by mole and the amount of the trimellitic anhydride is changed from 2.1 parts by mole used in the synthesis of the polyester resin A to 0.16 part by mole, and a polyester resin particle dispersion K is prepared in the same manner as in the preparation of the polyester resin particle dispersion A.

Preparation of Colorant Dispersion

Carbon Black (manufactured by Cabot Corporation: R330): 200 parts by weight

Anionic Surfactant (manufactured by Dai-Ichi Kogyo Seiyaku Co., Ltd., Neogen S.C.): 33 parts by weight (60% of active ingredient, 10% with respect to the colorant)

Ion Exchange Water: 750 parts by weight

In a stainless steel container having such a size that when all of the above components are put, the liquid level is about one-third of the height of the container, 280 parts by weight of the ion exchange water and 33 parts by weight of the anionic surfactant are put to sufficiently dissolve the surfactant. Then, the entire solid solution pigment is put, and the mixture is stirred using a stirrer until the unwetted pigment is no longer seen, while being sufficiently defoamed. After the defoaming, the rest of the ion exchange water is added and dispersion is carried out using a homogenizer (manufactured by TKA Japan K.K., ULTRA-TURRAX T50) through 5000 rotations for 10 minutes, and then the resultant material is defoamed by being stirred for one whole day and night using a stirrer. After the defoaming, dispersion is carried out again using a homogenizer through 6000 rotations for 10 minutes, and is then defoamed by being stirred for one whole day and night using a stirrer. Next, the dispersion is dispersed at a pressure of 240 MPa using a high-pressure impact-type dispersing machine ULTIMIZER (manufactured by Sugino Machine Limited, HJP 30006). The dispersion is carried out to an extent equivalent to 25 passes in terms of the total feed amount and the processing capability of the device. The obtained dispersion is left for 72 hours to remove precipitates, and ion exchange water is added thereto to adjust the solid content concentration to 15%. The volume average particle size D50 of the particles in the colorant dispersion is 135 nm.

Preparation of Release Agent Dispersion

Hydrocarbon Wax (manufactured by Nippon Seiro Co., Ltd., trade name: FNP 0080, melting temperature: 80° C.): 270 parts by weight Anionic Surfactant (manufactured by Dai-Ichi Kogyo Seiyaku Co., Ltd., Neogen RK, active ingredient content: 60%): 13.5 parts by weight (3.0% with respect to the release agent in terms of active ingredient)

Ion Exchange Water: 21.6 parts by weight

The above components are mixed, and the release agent is dissolved using a pressure discharge-type homogenizer (manufactured by APV Gaulin, Gaulin Homogenizer) at an internal liquid temperature of 120° C. Then, the mixture is subjected to a dispersion treatment for 120 minutes at a dispersion pressure of 5 MPa, and for 360 minutes at a dispersion pressure of 40 MPa, and is cooled, thereby obtaining a release agent dispersion. The volume average particle size D50 of the particles in the release agent dispersion is 225 nm. Then, ion exchange water is added thereto to adjust the solid content concentration to 20.0%.

Preparation of Aqueous Aluminum Sulfate Solution

Aluminum Sulfate Powder (manufactured by Asada Chemical Industry Co., Ltd.: 17% aluminum sulfate): 35 parts by weight Ion Exchange Water: 1,965 parts by weight The above components are put into a 2-liter container, and are stirred and mixed at 30° C. until precipitates disappear. Thus, an aqueous aluminum sulfate solution is prepared.

Example 1

Preparation of Toner 1

Polyester Resin Dispersion A: 750 parts by weight

Colorant Dispersion: 133 parts by weight

Release Agent Dispersion: 100 parts by weight

Ion Exchange Water: 350 parts by weight

Anionic Surfactant (manufactured by Dow Chemical Company, Dowfax 2A1): 2.9 parts by weight The above components are put into a 3-liter reaction container equipped with a thermometer, a pH meter, and a stirrer, and a 1.0% nitric acid is added thereto at a temperature of 25° C. to adjust the pH to 3.0. Then, while dispersion is performed at 5,000 rpm using a homogenizer (manufactured by TKA Japan K.K.: ULTRA-TURRAX T50), 130 parts by weight of the prepared aqueous aluminum sulfate solution is added and dispersed for 6 minutes.

Then, a stirrer and a mantle heater are installed on the reaction container, and while the speed of rotation of the stirrer is adjusted so that the slurry is sufficiently stirred, the temperature is increased to a temperature of 40° C. at a rate of temperature increase of 0.2° C./min, and increased at a rate of temperature increase of 0.05° C./min after 40° C., and the particle size is measured every 10 minutes using a Multisizer II (aperture diameter: 50 μm, manufactured by Beckman Coulter Inc.). When the volume average particle size reaches 5.0 μm, the temperature is maintained, and 50 parts by weight of the polyester resin dispersion A is added thereto over 5 minutes.

After maintaining for 30 minutes, the pH is adjusted to 9.0 using a 1% aqueous sodium hydroxide. Then, while the pH is similarly adjusted to 9.0 at every increase of 5° C., the temperature is increased to 90° C. at a rate of temperature increase of 1° C./min, and the system is maintained at 90° C. The particle shape and the surface properties are observed every 15 minutes using an optical microscope and a scanning electron microscope (FE-SEM), and unification of the particles is confirmed after 2.0 hours. The container is cooled to 30° C. with cooling water over 5 minutes.

The slurry after cooling is allowed to pass through a nylon mesh having an opening size of 15 μm to thereby remove coarse powders, and a nitric acid is added to the toner slurry that has passed through the mesh, to adjust the pH to 6.0, and then the slurry is filtered under reduced pressure using an aspirator.

The toner left on the filter paper after washing is crushed with the hand as finely as possible, and is put into ion exchange water, the amount of which is equivalent to ten times the amount of the toner, at a temperature of 30° C. The mixture is stirred and mixed for 30 minutes, and then the temperature is increased to a temperature of 80° C. for 60 minutes. A compound having an imidazoline structure ("VA044 (manufactured by Wako Pure Chemical Industries, Ltd.): 2,2'-azobis[2-(2-imidazoline-2-yl)propane]dihydrochloride) is put in an amount of 1.0% by weight with respect to the total weight of the toner particles, and the resultant is further stirred and mixed for 180 minutes.

After cooling, filtration under reduced pressure is carried out using an aspirator. The toner left on the filter paper is crushed with the hand as finely as possible, and is put into ion exchange water, the amount of which is equivalent to ten times the amount of the toner, at a temperature of 30° C. The mixture is stirred and mixed for 30 minutes, and then filtered again under reduced pressure using an aspirator to measure the electric conductivity of the filtrate. This operation is repeatedly performed until the electric conductivity of the filtrate is 10 μS/cm or less, and the toner particles are washed.

The washed toner particles are finely crushed using a wet/dry granulator (COMIL), and then vacuum-dried in an oven at 35° C. for 36 hours, thereby obtaining toner particles. 0.5 part by weight of hydrophobic silica (TG820) is added to 100 parts by weight of the obtained toner particles, and the resultant is mixed for 30 seconds at 13,000 rpm using a sample mill. Then, sieving is performed with a vibrating screen having an opening size of 45 μn, thereby obtaining a toner 1.

Evaluations

The toners 1 obtained in the respective examples are used as a non-magnetic single-component developer, and accommodated in a developing machine of an image forming apparatus "DocuPrint D300d" (manufactured by Fuji Xerox Co., Ltd.: positive charging type, non-magnetic single-component developing-type image forming apparatus).

Using the image forming apparatus, an image having a size of 5 cm×5 cm with an image density of 100% is formed on A4 paper (P paper, manufactured by Fuji Xerox Co., Ltd.) under a normal-temperature and normal-humidity environment of a temperature of 22° C. and a humidity of 50%. This is output on 100 pieces of paper, and the 100-th (initial time) image is evaluated for fogging and image density. In-apparatus dirt is also evaluated.

Next, the same image is output on 1000 pieces of paper under a high-temperature and high-humidity environment of a temperature of 28° C. and a humidity of 80%, and the 1000-th (after the lapse of a time) image is evaluated for fogging and image density. In-apparatus dirt is also evaluated.

The results are shown in Table 1.

Fogging Evaluation

In the fogging evaluation, the density of a non-image part is measured using an image densitometer (X-Rite 938, manufactured by X-Rite, Incorporated.) to measure ΔE between the non-image part and paper having no printed image.

The evaluation standards are as follows, and the practical use is possible at Level B or better.

A: ΔE is less than 0.1.

B+: ΔE is from 0.1 to less than 0.3.

B: ΔE is from 0.3 to less than 0.5.

C: ΔE is 0.5 or greater.

Image Density Evaluation

In the image density evaluation, the density of an image part is measured using an image densitometer (X-Rite 938, manufactured by X-Rite, Incorporated.).

The evaluation standards are as follows, and the practical use is possible at Level B or better.

A: 1.6 or greater

B+: from 1.5 to less than 1.6

B: from 1.4 to less than 1.5

C: less than 1.4

In-Apparatus Dirt Evaluation

The in-apparatus dirt is evaluated by visually judging the dirt by the toner in the apparatus.

The evaluation standars are as follows, and the practical use is possible at Level C or better.

A: No dirt is observed.

B: Partial dirt is observed.

C: About one half of dirt is observed.

CC: Dirt is observed as a whole.

Example 2

Preparation of Toner 2

A toner 2 is obtained in the same manner as in the case of the toner 1, except that the amount of VA044 used in the preparation of the toner 1 is changed to 0.9% by weight with respect to the total weight of the toner particles, and is evaluated in the same manner as in Example 1. The results thereof are shown in Table 1.

Example 3

Preparation of Toner 3

A toner 3 is obtained in the same manner as in the case of the toner 1, except that the amount of VA044 used in the preparation of the toner 1 is changed to 3% by weight with respect to the total weight of the toner particles, and is evaluated in the same manner as in Example 1. The results thereof are shown in Table 1.

Example 4

Preparation of Toner 4

A toner 4 is obtained in the same manner as in the case of the toner 1, except that the polyester resin dispersion E is used in place of the polyester resin dispersion A and the amount of VA044 used in the preparation of the toner 1 is changed to 3% by weight with respect to the total weight of the toner particles, and is evaluated in the same manner as in Example 1. The results thereof are shown in Table 1.

Example 5

Preparation of Toner 5

A toner 5 is obtained in the same manner as in the case of the toner 1, except that the polyester resin dispersion E is used in place of the polyester resin dispersion A and the amount of VA044 used in the preparation of the toner 1 is changed to 0.9% by weight with respect to the total weight of the toner particles, and is evaluated in the same manner as in Example 1. The results thereof are shown in Table 1.

Example 6

Preparation of Toner 6

A toner 6 is obtained in the same manner as in the case of the toner 1, except that the polyester resin dispersion D is used in place of the polyester resin dispersion A and the amount of VA044 used in the preparation of the toner 1 is changed to 3% by weight with respect to the total weight of the toner particles, and is evaluated in the same manner as in Example 1. The results thereof are shown in Table 1.

Example 7

Preparation of Toner 7

A toner 7 is obtained in the same manner as in the case of the toner 1, except that the amount of VA044 used in the preparation of the toner 1 is changed to 4% by weight with respect to the total weight of the toner particles, and is evaluated in the same manner as in Example 1. The results thereof are shown in Table 1.

Example 8

Preparation of Toner 8

A toner 8 is obtained in the same manner as in the case of the toner 1, except that the polyester resin dispersion E is used in place of the polyester resin dispersion A and the amount of VA044 used in the preparation of the toner 1 is changed to 4% by weight with respect to the total weight of the toner particles in the preparation of the toner 1, and is evaluated in the same manner as in Example 1. The results thereof are shown in Table 1.

Example 9

Preparation of Toner 9

A toner 9 is obtained in the same manner as in the case of the toner 1, except that the polyester resin dispersion F is used in place of the polyester resin dispersion A and the amount of VA044 used in the preparation of the toner 1 is changed to 3% by weight with respect to the total weight of the toner particles in the preparation of the toner 1, and is evaluated in the same manner as in Example 1. The results thereof are shown in Table 1.

Example 10

Preparation of Toner 10

A toner 10 is obtained in the same manner as in the case of the toner 1, except that the polyester resin dispersion F is used in place of the polyester resin dispersion A and the amount of VA044 used in the preparation of the toner 1 is changed to 0.9% by weight with respect to the total weight of the toner particles in the preparation of the toner 1, and is evaluated in the same manner as in Example 1. The results thereof are shown in Table 1.

Example 11

Preparation of Toner 11

A toner 11 is obtained in the same manner as in the case of the toner 1, except that the polyester resin dispersion E is used in place of the polyester resin dispersion A and the amount of VA044 used in the preparation of the toner 1 is changed to 0.7% by weight with respect to the total weight of the toner particles in the preparation of the toner 1, and is evaluated in the same manner as in Example 1. The results thereof are shown in Table 1.

Example 12

Preparation of Toner 12

A toner 12 is obtained in the same manner as in the case of the toner 1, except that the amount of VA044 used in the preparation of the toner 1 is changed to 0.7% by weight with respect to the total weight of the toner particles in the preparation of the toner 1, and is evaluated in the same manner as in Example 1. The results thereof are shown in Table 1.

Example 13

Preparation of Toner 13

A toner 13 is obtained in the same manner as in the case of the toner 1, except that the polyester resin dispersion D is used in place of the polyester resin dispersion A and the amount of VA044 used in the preparation of the toner 1 is changed to 0.9% by weight with respect to the total weight of the toner particles in the preparation of the toner 1, and is evaluated in the same manner as in Example 1. The results thereof are shown in Table 1.

Example 14

Preparation of Toner 14

A toner 14 is obtained in the same manner as in the case of the toner 1, except that the polyester resin dispersion 0 is used in place of the polyester resin dispersion A and the amount of VA044 used in the preparation of the toner 1 is changed to 5% by weight with respect to the total weight of the toner particles in the preparation of the toner 1, and is evaluated in the same manner as in Example 1. The results thereof are shown in Table 1.

Example 15

Preparation of Toner 15

A toner 15 is obtained in the same manner as in the case of the toner 1, except that the polyester resin dispersion G is used in place of the polyester resin dispersion A and the amount of VA044 used in the preparation of the toner 1 is changed to 5% by weight with respect to the total weight of the toner particles in the preparation of the toner 1, and is evaluated in the same manner as in Example 1. The results thereof are shown in Table 1.

Example 16

Preparation of Toner 16

A toner 16 is obtained in the same manner as in the case of the toner 1, except that the polyester resin dispersion G is used in place of the polyester resin dispersion A and the amount of VA044 used in the preparation of the toner 1 is changed to 0.6% by weight with respect to the total weight of the toner particles in the preparation of the toner 1, and is evaluated in the same manner as in Example 1. The results thereof are shown in Table 1.

Example 17

Preparation of Toner 17

A toner 17 is obtained in the same manner as in the case of the toner 1, except that the polyester resin dispersion D is used in place of the polyester resin dispersion A and the amount of VA044 used in the preparation of the toner 1 is changed to 0.6% by weight with respect to the total weight of the toner particles in the preparation of the toner 1, and is evaluated in the same manner as in Example 1. The results thereof are shown in Table 1.

Example 18

Preparation of Toner 18

A toner 18 is obtained in the same manner as in the case of the toner 1, except that the polyester resin dispersion C is used in place of the polyester resin dispersion A and the amount of VA044 used in the preparation of the toner 1 is changed to 5% by weight with respect to the total weight of the toner particles in the preparation of the toner 1, and is evaluated in the same manner as in Example 1. The results thereof are shown in Table 1.

Example 19

Preparation of Toner 19

A toner 19 is obtained in the same manner as in the case of the toner 1, except that the polyester resin dispersion D is used in place of the polyester resin dispersion A and the amount of VA044 used in the preparation of the toner 1 is changed to 6% by weight with respect to the total weight of the toner particles in the preparation of the toner 1, and is evaluated in the same manner as in Example 1. The results thereof are shown in Table 1.

Example 20

Preparation of Toner 20

A toner 20 is obtained in the same manner as in the case of the toner 1, except that the polyester resin dispersion G is used in place of the polyester resin dispersion A and the amount of VA044 used in the preparation of the toner 1 is changed to 6% by weight with respect to the total weight of the toner particles in the preparation of the toner 1, and is evaluated in the same manner as in Example 1. The results thereof are shown in Table 1.

Example 21

Preparation of Toner 21

A toner 21 is obtained in the same manner as in the case of the toner 1, except that the polyester resin dispersion H is used in place of the polyester resin dispersion A and the amount of VA044 used in the preparation of the toner 1 is changed to 5% by weight with respect to the total weight of the toner particles in the preparation of the toner 1, and is evaluated in the same manner as in Example 1. The results thereof are shown in Table 2.

Example 22

Preparation of Toner 22

A toner 22 is obtained in the same manner as in the case of the toner 1, except that the polyester resin dispersion H is used in place of the polyester resin dispersion A and the amount of VA044 used in the preparation of the toner 1 is changed to 0.6% by weight with respect to the total weight of the toner particles in the preparation of the toner 1, and is evaluated in the same manner as in Example 1. The results thereof are shown in Table 2.

Example 23

Preparation of Toner 23

A toner 23 is obtained in the same manner as in the case of the toner 1, except that the polyester resin dispersion G is used in place of the polyester resin dispersion A and the amount of VA044 used in the preparation of the toner 1 is changed to 0.4% by weight with respect to the total weight of the toner particles in the preparation of the toner 1, and is evaluated in the same manner as in Example 1. The results thereof are shown in Table 2.

Example 24

Preparation of Toner 24

A toner 24 is obtained in the same manner as in the case of the toner 1, except that the polyester resin dispersion D is used in place of the polyester resin dispersion A and the amount of VA044 used in the preparation of the toner 1 is changed to 0.4% by weight with respect to the total weight of the toner particles in the preparation of the toner 1, and is evaluated in the same manner as in Example 1. The results thereof are shown in Table 2.

Example 25

Preparation of Toner 25

A toner 25 is obtained in the same manner as in the case of the toner 1, except that the polyester resin dispersion C is used in place of the polyester resin dispersion A and the amount of VA044 used in the preparation of the toner 1 is changed to 0.6% by weight with respect to the total weight of the toner particles in the preparation of the toner 1, and is evaluated in the same manner as in Example 1. The results thereof are shown in Table 2.

Example 26

Preparation of Toner 26

A toner 26 is obtained in the same manner as in the case of the toner 1, except that the polyester resin dispersion B is used in place of the polyester resin dispersion A and the amount of VA044 used in the preparation of the toner 1 is changed to 10% by weight with respect to the total weight of the toner particles in the preparation of the toner 1, and is evaluated in the same manner as in Example 1. The results thereof are shown in Table 2.

Example 27

Preparation of Toner 27

A toner 27 is obtained in the same manner as in the case of the toner 1, except that the polyester resin dispersion I is used in place of the polyester resin dispersion A and the amount of VA044 used in the preparation of the toner 1 is changed to 10% by weight with respect to the total weight of the toner particles in the preparation of the toner 1, and is evaluated in the same manner as in Example 1. The results thereof are shown in Table 2.

Example 28

Preparation of Toner 28

A toner 28 is obtained in the same manner as in the case of the toner 1, except that the polyester resin dispersion I is used in place of the polyester resin dispersion A and the amount of VA044 used in the preparation of the toner 1 is changed to 0.1% by weight with respect to the total weight of the toner particles in the preparation of the toner 1, and is evaluated in the same manner as in Example 1. The results thereof are shown in Table 2.

Example 29

Preparation of Toner 29

A toner 29 is obtained in the same manner as in the case of the toner 1, except that the polyester resin dispersion B is used in place of the polyester resin dispersion A and the amount of VA044 used in the preparation of the toner 1 is changed to 0.1% by weight with respect to the total weight of the toner particles in the preparation of the toner 1, and is evaluated in the same manner as in Example 1. The results thereof are shown in Table 2.

Comparative Example 1

Preparation of Toner 30

A toner 30 is obtained in the same manner as in the case of the toner 1, except that the polyester resin dispersion K is used in place of the polyester resin dispersion A and the amount of VA044 used in the preparation of the toner 1 is changed to 10% by weight with respect to the total weight of the toner particles in the preparation of the toner 1, and is evaluated in the same manner as in Example 1. The results thereof are shown in Table 2.

Comparative Example 2

Preparation of Toner 31

A toner 31 is obtained in the same manner as in the case of the toner 1, except that the polyester resin dispersion B is used in place of the polyester resin dispersion A and the amount of VA044 used in the preparation of the toner 1 is changed to 12% by weight with respect to the total weight of the toner particles in the preparation of the toner 1, and is evaluated in the same manner as in Example 1. The results thereof are shown in Table 2.

Comparative Example 3

Preparation of Toner 32

A toner 32 is obtained in the same manner as in the case of the toner 1, except that the polyester resin dispersion I is used in place of the polyester resin dispersion A and the amount of VA044 used in the preparation of the toner 1 is changed to 12% by weight with respect to the total weight of the toner particles in the preparation of the toner 1, and is evaluated in the same manner as in Example 1. The results thereof are shown in Table 2.

Comparative Example 4

Preparation of Toner 33

A toner 33 is obtained in the same manner as in the case of the toner 1, except that the polyester resin dispersion J is used in place of the polyester resin dispersion A and the amount of VA044 used in the preparation of the toner 1 is changed to 10% by weight with respect to the total weight of the toner particles in the preparation of the toner 1, and is evaluated in the same manner as in Example 1. The results thereof are shown in Table 2.

Comparative Example 5

Preparation of Toner 34

A toner 34 is obtained in the same manner as in the case of the toner 1, except that the polyester resin dispersion J is used in place of the polyester resin dispersion A and the amount of VA044 used in the preparation of the toner 1 is changed to 0.1% by weight with respect to the total weight of the toner particles in the preparation of the toner 1, and is evaluated in the same manner as in Example 1. The results thereof are shown in Table 2.

Comparative Example 6

Preparation of Toner 35

A toner 35 is obtained in the same manner as in the case of the toner 1, except that the polyester resin dispersion I is used in place of the polyester resin dispersion A and the amount of VA044 used in the preparation of the toner 1 is changed to 0.08% by weight with respect to the total weight of the toner particles in the preparation of the toner 1, and is evaluated in the same manner as in Example 1. The results thereof are shown in Table 2.

Comparative Example 7

Preparation of Toner 36

A toner 36 is obtained in the same manner as in the case of the toner 1, except that the polyester resin dispersion B is used in place of the polyester resin dispersion A and the amount of VA044 used in the preparation of the toner 1 is changed to 0.08% by weight with respect to the total weight of the toner particles in the preparation of the toner 1, and is evaluated in the same manner as in Example 1. The results thereof are shown in Table 2.

Comparative Example 8

Preparation of Toner 37

A toner 37 is obtained in the same manner as in the case of the toner 1, except that the polyester resin dispersion K is used in place of the polyester resin dispersion A and the amount of VA044 used in the preparation of the toner 1 is changed to 0.1% by weight with respect to the total weight of the toner particles in the preparation of the toner 1, and is evaluated in the same manner as in Example 1. The results thereof are shown in Table 2.

Example 30

Preparation of Toner 38

A toner 38 is obtained in the same manner as in the case of the toner 1, except that a compound having an imidazoline structure ("VA060" (manufactured by Wako Pure Chemical Industries, Ltd.): 2,2'-azobis{2-[1-(2-hydroxyethyl)-2-imidazoline-2-yl]propane}dihydrochloride) is used in place of VA044, and is evaluated in the same manner as in Example 1. The results thereof are shown in Table 2.

TABLE 1

| | | Polyester Resin Trimellitic Anhydride | | | Manufacturing of Toner Compound Having Imidazoline Structure | |
|---|---|---|---|---|---|---|
| | Toner No. | Polyester Dispersion | Blending Amount (parts by mole) | mol % with respect to Entire Polymerization Components | Type | Blending Amount (wt %) (with respect to Total Weight of Toner Particles) |
| Example 1 | Toner 1 | A | 2.1 | 1.05 | VA044 | 1 |
| Example 2 | Toner 2 | A | 2.1 | 1.05 | VA044 | 0.9 |
| Example 3 | Toner 3 | A | 2.1 | 1.05 | VA044 | 3 |
| Example 4 | Toner 4 | E | 5.6 | 2.8 | VA044 | 3 |
| Example 5 | Toner 5 | E | 5.6 | 2.8 | VA044 | 0.9 |
| Example 6 | Toner 6 | D | 1.4 | 0.7 | VA044 | 3 |
| Example 7 | Toner 7 | A | 2.1 | 1.05 | VA044 | 4 |
| Example 8 | Toner 8 | E | 5.6 | 2.8 | VA044 | 4 |
| Example 9 | Toner 9 | F | 6.4 | 3.2 | VA044 | 3 |
| Example 10 | Toner 10 | F | 6.4 | 3.2 | VA044 | 0.9 |
| Example 11 | Toner 11 | E | 5.6 | 2.8 | VA044 | 0.7 |
| Example 12 | Toner 12 | A | 2.1 | 1.05 | VA044 | 0.7 |
| Example 13 | Toner 13 | D | 1.4 | 0.7 | VA044 | 0.9 |
| Example 14 | Toner 14 | D | 1.4 | 0.7 | VA044 | 5 |
| Example 15 | Toner 15 | G | 9.4 | 4.7 | VA044 | 5 |
| Example 16 | Toner 16 | G | 9.4 | 4.7 | VA044 | 0.6 |
| Example 17 | Toner 17 | D | 1.4 | 0.7 | VA044 | 0.6 |
| Example 18 | Toner 18 | C | 0.8 | 0.4 | VA044 | 5 |
| Example 19 | Toner 19 | D | 1.4 | 0.7 | VA044 | 6 |
| Example 20 | Toner 20 | G | 9.4 | 4.7 | VA044 | 6 |

| | Evaluations | | | | | |
|---|---|---|---|---|---|---|
| | Initial Time | | | After Lapse of Time | | |
| | Fogging | In-Apparatus Dirt | Image Density | Fogging | In-Apparatus Dirt | Image Density |
| Example 1 | A | A | A | A | A | A |
| Example 2 | A | A | A | A | A | A |
| Example 3 | A | A | A | A | A | A |
| Example 4 | A | A | A | A | A | A |
| Example 5 | A | A | A | A | A | A |
| Example 6 | A | A | A | A | A | B+ |
| Example 7 | A | A | A | A | A | B+ |
| Example 8 | A | A | A | A | A | B+ |
| Example 9 | A | A | A | B+ | A | A |
| Example 10 | A | A | A | B+ | A | A |
| Example 11 | A | A | A | A | B | A |
| Example 12 | A | A | A | A | B | A |
| Example 13 | A | A | A | A | A | B+ |
| Example 14 | A | A | A | A | A | B+ |
| Example 15 | A | A | A | B+ | A | B+ |
| Example 16 | A | A | A | B+ | B | A |
| Example 17 | A | A | A | A | B | B+ |
| Example 18 | A | A | A | A | A | B |
| Example 19 | A | A | A | A | A | B |
| Example 20 | A | A | A | B+ | A | B |

TABLE 2

| | | Polyester Resin Trimellitic Anhydride | | | Manufacturing of Toner Compound Having Imidazoline Structure | |
|---|---|---|---|---|---|---|
| | Toner No. | Polyester Dispersion | Blending Amount (parts by mole) | mol % with respect to Entire Polymerization Components | Type | Blending Amount (wt %) (with respect to Total Weight of Toner Particles) |
| Example 21 | Toner 21 | H | 10.2 | 5.1 | VA044 | 5 |
| Example 22 | Toner 22 | H | 10.2 | 5.1 | VA044 | 0.6 |
| Example 23 | Toner 23 | G | 9.4 | 4.7 | VA044 | 0.4 |
| Example 24 | Toner 24 | D | 1.4 | 0.7 | VA044 | 0.4 |
| Example 25 | Toner 25 | C | 0.8 | 0.4 | VA044 | 0.6 |
| Example 26 | Toner 26 | B | 0.2 | 0.1 | VA044 | 10 |

TABLE 2-continued

| | | | | | | |
|---|---|---|---|---|---|---|
| Example 27 | Toner 27 | I | 19.4 | 9.7 | VA044 | 10 |
| Example 28 | Toner 28 | I | 19.4 | 9.7 | VA044 | 0.1 |
| Example 29 | Toner 29 | B | 0.2 | 0.1 | VA044 | 0.1 |
| Example 30 | Toner 38 | A | 2.1 | 1.05 | VA060 | 1 |
| Comparative Example 1 | Toner 30 | K | 0.16 | 0.08 | VA044 | 10 |
| Comparative Example 2 | Toner 31 | B | 0.2 | 0.1 | VA044 | 12 |
| Comparative Example 3 | Toner 32 | I | 19.4 | 9.7 | VA044 | 12 |
| Comparative Example 4 | Toner 33 | J | 20.4 | 10.2 | VA044 | 10 |
| Comparative Example 5 | Toner 34 | J | 20.4 | 10.2 | VA044 | 0.1 |
| Comparative Example 6 | Toner 35 | I | 19.4 | 9.7 | VA044 | 0.08 |
| Comparative Example 7 | Toner 36 | B | 0.2 | 0.1 | VA044 | 0.08 |
| Comparative Example 8 | Toner 37 | K | 0.16 | 0.08 | VA044 | 0.1 |

| | Evaluations | | | | | |
|---|---|---|---|---|---|---|
| | Initial Time | | | After Lapse of Time | | |
| | Fogging | In-Apparatus Dirt | Image Density | Fogging | In-Apparatus Dirt | Image Density |
| Example 21 | A | A | A | B | A | B+ |
| Example 22 | A | A | A | B | B | A |
| Example 23 | A | A | A | B+ | C | A |
| Example 24 | A | A | A | A | C | B+ |
| Example 25 | A | A | A | A | B | B |
| Example 26 | A | A | B+ | A | A | B |
| Example 27 | A | A | A | B | A | B |
| Example 28 | A | A | A | B | C | A |
| Example 29 | A | A | A | A | C | B |
| Example 30 | A | A | A | A | A | A |
| Comparative Example 1 | A | A | B+ | A | A | C |
| Comparative Example 2 | A | A | B+ | A | A | C |
| Comparative Example 3 | A | A | A | B | A | C |
| Comparative Example 4 | A | A | A | C | A | B |
| Comparative Example 5 | A | A | A | C | C | A |
| Comparative Example 6 | A | A | A | B | CC | A |
| Comparative Example 7 | A | A | A | A | CC | B |
| Comparative Example 8 | A | A | A | A | C | C |

From the above results, it is found that the toners of the examples are positively-charged toners and have good results especially atter the lapse of time in the fogging, image density, and in-apparatus dirt evaluations, as compared with the comparative examples.

Hereinafter, the abbreviations in the tables will be shown in detail.

VA044: "VA044" (manufactured by Wako Pure Chemical Industries, Ltd.): 2,2'-azobis[2-(2-imidazoline-2-yl)propane] dihydrochloride VA060: "VA060" (manufactured by Wako Pure Chemical Industries, Ltd.): 2,2'-azobis{2-[1-(2-hydroxyethyl)-2-imidazoline-2-yl]propane}dihydrochloride The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles comprising a polyester resin having an ethylenic unsaturated bond, and a reaction product of the polyester resin and a compound having an imidazoline structure, wherein the polyester resin has repeat units derived from a polyol and a polycarboxylic acid including a trimellitic acid, and a molar ratio of the repeat units derived from the trimellitic acid is from 0.1 mol% to 10 mol% with respect to the entire polymerization components of the polyester resin, and the reaction product exists in a surface part of the toner particles, and a weight ratio of the compound having an imidazoline structure is from 0.1% by weight to 10% by weight with respect to the total weight of the toner particles excluding the compound having an imidazoline structure.

2. The electrostatic charge image developing toner according to claim 1, wherein the molar ratio of the trimellitic acid is from 0.5 mol % to 5.0 mol % with respect to the entire polymerization components of the polyester resin.

3. The electrostatic charge image developing toner according to claim 1, wherein the molar ratio of the trimellitic acid is from 0.8 mol % to 3.0 mol % with respect to the entire polymerization components of the polyester resin.

4. The electrostatic charge image developing toner according to claim 1, wherein the weight ratio of the compound having an imidazoline structure is from 0.5% by weight to 5.0% by weight with respect to the total weight of the toner particles excluding the compound having an imidazoline structure.

5. The electrostatic charge image developing toner according to claim 1, wherein the weight ratio of the compound having an imidazoline structure is from 0.8% by weight to 3.0% by weight with respect to the total weight of the toner particles excluding the compound having an imidazoline structure.

6. The electrostatic charge image developing toner according to claim 1, wherein the compound having an imidazoline structure is a compound including the imidazoline structure and an azo group in the same molecule.

7. An electrostatic charge image developer comprising:

the electrostatic charge image developing toner according to claim 1.

8. A process cartridge that is detachable from 10° C. an image forming apparatus, comprising:

a developing unit that accommodates the electrostatic charge image developer according to claim 7 and develops an electrostatic charge image formed on an image holding member with the electrostatic charge image developer to form a toner image.

9. An image forming apparatus comprising:

an image holding member;

a charging unit that charges the image holding member;

an electrostatic charge image forming unit that forms an electrostatic charge image on a surface of a charged image holding member;

a developing unit that accommodates the electrostatic charge image developer according to claim 7 and develops the electrostatic charge image formed on the image holding member with the electrostatic charge image developer to form a toner image;

a transfer unit that transfers the toner image formed on the image holding member onto a recording medium; and a fixing unit that fixes the toner image transferred onto the recording medium.

10. An image forming method comprising:

charging an image holding member;

forming an electrostatic charge image on a surface of a charged image holding member;

developing the electrostatic charge image formed on the image holding member with the electrostatic charge image developer according to claim 7 to form a toner image;

transferring the toner image formed on the image holding member onto a recording medium; and fixing the toner image transferred onto the recording medium.

11. A toner cartridge that accommodates the electrostatic charge image developing toner according to claim 1 and is detachable from an image forming apparatus.

* * * * *